United States Patent [19]

Fissmann et al.

[11] Patent Number: 4,502,231

[45] Date of Patent: Mar. 5, 1985

[54] AIR GUIDE BOX FOR THE DRYER SECTION OF A PAPER MAKING MACHINE

[75] Inventors: Hans-Joachim Fissmann; Albrecht Meinecke, both of Heidenheim; Manfred Kemmer, Nattheim, all of Fed. Rep. of Germany

[73] Assignee: J. M. Voith, GmbH, Heidenheim, Fed. Rep. of Germany

[21] Appl. No.: 532,353

[22] Filed: Sep. 15, 1983

[30] Foreign Application Priority Data

Oct. 2, 1982 [DE] Fed. Rep. of Germany ..... 3236576

[51] Int. Cl.[3] ..... F26B 13/08

[52] U.S. Cl. ..... 34/114; 34/116; 34/117; 34/120; 34/123

[58] Field of Search ..... 34/114, 116, 117, 120, 34/122, 123

[56] References Cited

FOREIGN PATENT DOCUMENTS

| | | | |
|---|---|---|---|
| 51055 | 5/1982 | European Pat. Off. | 34/114 |
| 3148578 | 9/1982 | Fed. Rep. of Germany . | |
| WO81/01428 | 5/1981 | PCT Int'l Appl. . | |

*Primary Examiner*—Larry I. Schwartz
*Assistant Examiner*—David W. Westphal
*Attorney, Agent, or Firm*—Lon H. Romanski

[57] ABSTRACT

An air guide box for the dryer section of a paper making machine is arranged as generally between two succeeding drying cylinders and along a continuous support band or belt which supports the associated paper web to be dried; the air guide box has an end of generally wedge-like configuration which extends at least some distance into the gore-like space as exists in the region where the support band or belt runs onto the next drying cylinder; a first gap exists generally between a first wall of the guide box and the running support band or belt while a second gap exists as between a second wall of the guide box and the juxtaposed surface of such next drying cylinder. In order to guide the paper web along the support band or belt in order to assure proper contact: (a) on the inflow side, an air wipe-off or barrier apparatus is provided as at the guide box; (b) the first gap preferably diverges from the first wall as the first gap more nearly approaches the gore-like space; (c) the guide box is connected to a blast air supply which, preferably, is directed through an opening and into the second gap as to have a flow direction generally opposite to the direction of rotation of such next drying cylinder; and (d) preferably the first and second gaps are interconnected by a passage with such interconnecting passage being situated as to occur before the air blast opening when viewed or considered in the direction of rotation of such next drying cylinder.

7 Claims, 3 Drawing Figures

Fig. 1
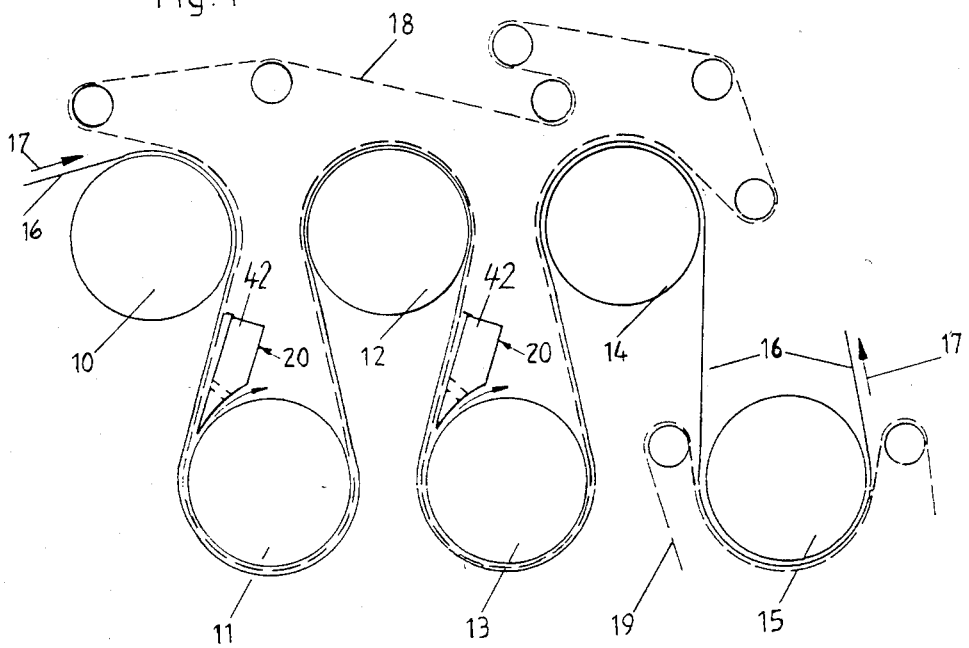
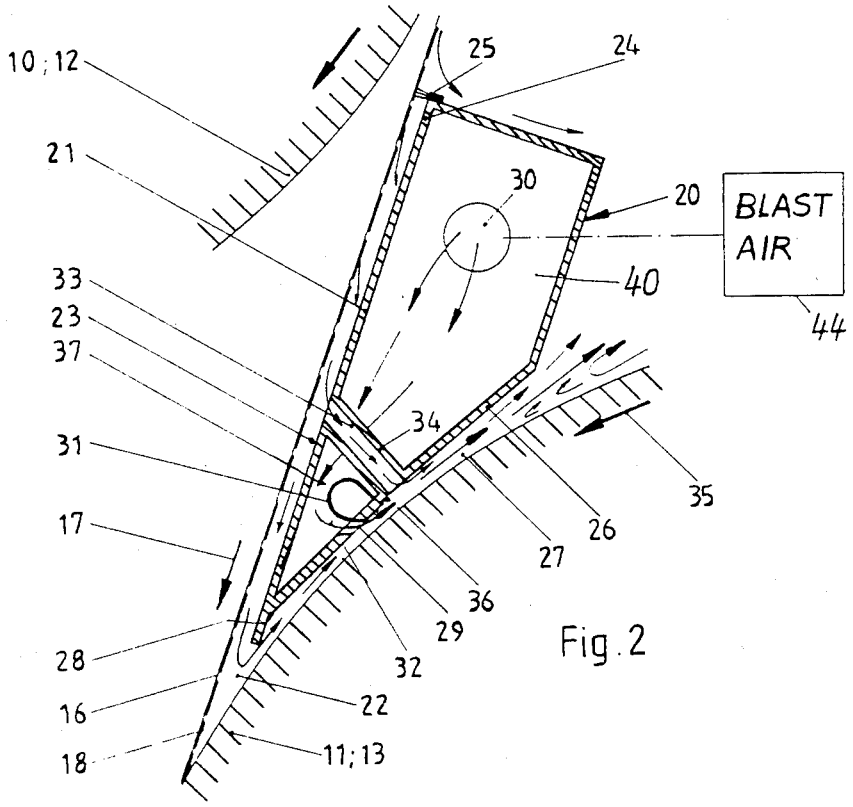
Fig. 2

AIR GUIDE BOX FOR THE DRYER SECTION OF A PAPER MAKING MACHINE

FIELD OF THE INVENTION

This invention relates generally to paper making machines and more particularly to the dryer section of such a paper making machine and, still more particularly, to apparatus for use with such a dryer section for enhancing the stability and contact of the running paper web as it is being carried by the associated support band or belt toward, against and away from associated drying cylinder or roller means.

BACKGROUND OF THE INVENTION AND PRIOR ART STATEMENT

It is known that in the drying section or portion of a paper making machine the moisture-bearing paper web is directed along a serpentine path in wrapping relation with drying cylinders or drums arranged as in tiers and having the cylinders in one tier staggered with respect to the cylinders or drums of the other tier. In such dryer sections it is not unusual to have a plurality of such drying cylinders or drums arranged in such tiers with the tiers (or rows) being arranged in respectively different elevations.

Generally, at the beginning of such a dryer section a support band or belt is provided which meanders over the drying cylinders or drums. Generally, the support band or belt means may be a porous, air-permeable endless support band or belt of a felt generally woven from cotton or a plastic or wire, or fabric belt. Quite often in such dryer sections, the drying cylinders of, for example, the lower-situated tier actually have the support band or belt means running directly against the outer periphery thereof while the wet paper web, carried by the support band means, is actually radially outwardly and against the radially outer most surface means of the support belt or band means. In contrast, the drying cylinders of, for example, the upper-situated tier actually have the paper web running directly against the outer periphery thereof and effectively, runningly, held thereagainst by the support belt or band means which is situated directly radially outwardly of and against the paper web to be dried.

The support band means, together with the moist paper web which possesses little strength at that time, runs through the initial region of the dryer section and in so doing the support band means supports the paper web and does so in particular at the free and otherwise unsupported stretches or runs between pairs of successive drying cylinders or drums. Again, as already pointed-out, the case of the assumed relatively upper tier drying cylinders, herein for ease of reference also referred to as outward cylinders or outward cylinder, the support band or belt means effectively, in running fashion, holds the paper web directly against the outer drying surface of the associated drying cylinder while, in contrast, in the case of the assumed relatively lower tier drying cylinders, herein for ease of reference also referred to as inward cylinders or inward cylinder, the running support band or belt means actually lies against the outer surface of the associated drying cylinder and between such outer surface of the drying cylinder and the paper web.

In paper making machines having an especially high operating speed, as for example surface speeds greater than 850 meters per minute, difficulties occur in guiding the paper web in the dryer section. In fact, it has been discovered that the paper web lifts off the support band means as it runs off the surface of an outward drying cylinder. The air consequently drawn-in between the paper web and the running support band or belt means often prevents contact between the paper web and the support band or belt means in the further movement or conduction of the paper web in its desired normal course. This, in turn, leads to an unstable running of the paper web exemplified as by a wagging, fluttering and even flapping-over of paper web edge. As the paper web runs generally onto the following inward drying cylinder, air is again forced between the paper web and the running support band means. Consequently, as the paper web passes generally about such inward drying cylinder, the air thusly forced between the paper web and the support band, causes the paper web to remain lifted off the support band so that paper web conduction or transportation becomes unstable in such areas. Such an undesirable action of the paper web results in a considerable reduction in the quality of the paper and an increased risk of tearing the paper during its progress into and through the dryer section.

The prior art as illustrated by, for example, International Publication Number WO81/01428 (under the Patent Cooperation Treaty) employs an air guide suction box or apparatus $13^{111}$(FIG. 6) which extends as by flat wall means along the support band between the outlet gore (or gore-like space) of an external or an outward drying cylinder and the inlet gore of an internal or inward drying cylinder. A second wall means of the suction box $13^{111}$ extends along the free surface of the internal or inward drying cylinder. At the inflow-side edge of these walls as well as in the inlet gore, the guide box $13^{111}$ is provided with air wipe-off strips; such strips are intended to suppress to a large extent the infiltration of air into gaps, at the support band and at the cylinder surface, defined by the two walls of the box. Also operatively connected to the box $13^{111}$ is a source of suction or vacuum 15 and such source communicates with openings both at the inflow-side edge of the box wall extending along the support band, 12, and at the gore-side edge of the wall associated with the drying cylinder. In this manner, the prior art intends to draw-off the air which despite the air wipe-off strips has been carried by the support band or belt means and by the cylinder surface into the respective gaps. Additionally, the gap extending along the support band, which gap is defined on the inflow and gore sides by additional air wipe-off strips directed against the support band, communicates with the atmosphere in the dryer section through channels discharging at the end toward the inlet gore. With such a prior art arrangement, it is hoped that the paper web will adhere to the support band or belt as in the area between two successive drying cylinders. However, apparatus conforming to such prior art teachings have not been found to be satisfactory. For example, it has been found that in such a prior art structure, the air will flow out of the gap on the support band side through the narrow channels of the box but only in a very small and insufficient quantity or rate. Further, such prior art structures, and in particular the air or suction boxes, are operationally unsafe because there is the danger that dust particles and fibers drawn-in with the drying air will soon obstruct or clog the suction or vacuum openings of the box $13^{111}$ and/or its flow paths.

The prior art as illustrated by Publication No. De-3148578 A1 of the Patent Office of the Federal Republic of Germany, employs, as shown in its FIGS. 6 and 8, air guide boxes where by the use of blast air the lifting-off of the paper web from the cooperating support band or belt in the region of the inlet gore is hopefully to be overcome and eliminated. To this end, in one form of the apparatus disclosed by said No. DE-3148578 A1, the air guide boxes are arranged directly before the inlet gore and blast air is ejected or directed both counter to the running direction of the support band means and counter to the direction of rotation of the adjacent drying cylinder. In another form or embodiment, of the teachings of said DE-3148578 A1, blast air is used only at the support band while an air wipe-off strip is directed against the free surface of the associated drying cylinder. The blast air as well as the air wipe-off strip each have the same purpose and that is to wipe off the air boundary layer entrained by the support band and/or by the drying cylinder and to prevent such air from penetrating into the inlet gore. However, tests and experience has shown that such structures embodying the teachings of said No. DE-3148578 A1 are less than acceptable. For example, it has been found that the paper web adheres against the support band but that such occurs only in a narrowly defined region along the band-side blast air ejection. Air having entered the inlet gore, despite the air guide box, causes a lifting-off of the paper web from the support belt or band. Further, because the surface of the support band presents a considerable resistance to the blast air stream, a relatively very high rate of blast air is required which, in and of itself is undesirable. However, as a further disadvantage, the provision of such a high rate of blast air often affects the heat balance of the dryer section in an undesirable manner.

The invention as herein disclosed and described is primarily directed to the solution of the foregoing as well as other related and attendant problems of the prior art.

SUMMARY OF THE INVENTION

According to the invention, an air guide box for the dryer section of a paper making machine wherein the paper web together with support band means meanders over drying cylinders, wherein the air guide box which extends crosswise through the dryer section between two successive cylinders and which extends along the support band means into the inlet gore between the said support band means and a drying cylinder, comprises a first wall which extends when viewed in transverse section of the box along the support band means and into the inlet gore, a gap remaining between said first wall and said support band means, air wipe-off means arranged on the inflow-side edge of said first wall and acting against said support band means, second wall means generally juxtaposed to a portion of the cylindrical surface of the drying cylinder, said second wall means operatively converging with said first wall in said inlet gore and forming a gap as between said second wall and said cylindrical surface, said second wall being provided with an opening for the passage of air, an associated blast air supply, and said opening being effective to deliver blast air into said gap between said second wall and said cylindrical surface in a direction counter to the direction of rotation of said drying cylinder.

Various general and specific objects, advantages and aspects of the invention will become apparent when reference is made to the following detailed description considered in conjunction with the accompanying drawings.

BRIEF DESCRIPTION OF THE DRAWINGS

In th drawings wherein for purposes of clarity certain details and/or elements may be omitted from one or more views:

FIG. 1 schematically illustrates a portion of the dryer section of a paper making machine with such dryer section having air guide box apparatus employing teachings of the invention;

FIG. 2 illustrates in enlarged scale a fragmentary portion of the structure of FIG. 1 and illustrates, in such enlarged scale, air guide box means, in transverse cross-section, of FIG. 1 embodying teachings of the invention.

DETAILED DESCRIPTION OF THE PREFERRED EMBODIMENT

Figure 3:
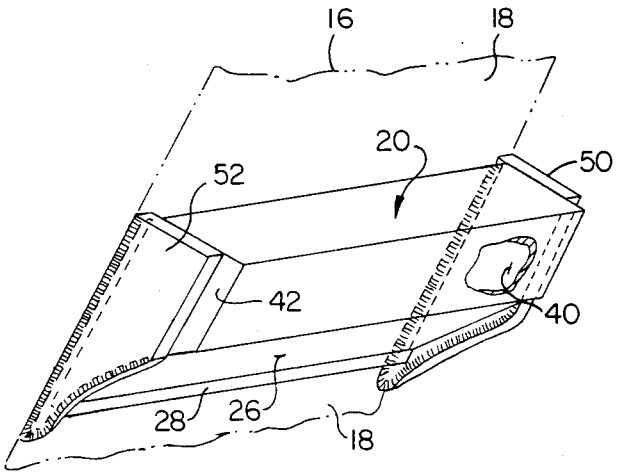
FIG. 3 illustrates in perspective and in somewhat reduced scale and in simplified form, with certain of the details eliminated for clarity, the air guide box means of FIG. 2 modified by the addition thereto of side air barrier means.

Referring now in greater detail to the drawings, in FIG. 1 the five drying cylinders 10, 11, 12, 13 and 14 comprise a drying group of a dryer section. An additional drying cylinder 15 is also depicted and such is intended to represent a drying cylinder belonging to a subsequent drying group.

By way of example, drying cylinders 10, 12 and 14 are arranged in a relatively upper tier, or row, while drying cylinders 11, 13 and 15 are arranged in a relatively lower tier, or row. A paper web 16 to be dried runs, generally meandering over the drying cylinders, in the direction of arrows 17. In so doing the paper web 16 is continuously accompanied within the first drying group (Cylinders 10, 11, 12, 13 and 14) as by an endless air-permeable support band or belt means 18. If the path of support band means 18 as depicted in FIG. 1 is considered as a closed or endless loop, then it becomes apparent that drying cylinders 10, 12 and 14 lie outside of such support band 18 loop and may be considered as being outer, outside or outward drying cylinders. Similarly, it becomes apparent that lower tier drying cylinders 11 and 13 lie inside of such support band 18 loop and may be considered as being inner, inside or inward drying cylinders. Because of this, in the general region of the upper cylinders 10, 12 and 14, the paper web runs or passes in a manner whereby it is generally sequentially contained (sandwiched) between portions of the cylindrical surfaces of cylinders 10, 12 and 14, and the support band means 18. In contrast, in the region of the lower tier cylinders 11 and 13, the paper web 16 passes as to be actually radially outwardly of, but against, the support band means 18 which is, at that point, directly against portions of the cylindrical surfaces of cylinders 11 and 13. At the free or unsupported portions between the cylinders, as for example between cylinders 10 to 11, 11 to 12, 12 to 13 and 13 to 14 the paper web 16 is guided by the support band or belt 18. A free or direct paper pull first exists as between cylinders 14 and 15. In the following drying groups of cylinders, as generally typically illustrated by cylinder 15, each cylinder tier or row has its own support band as generally typically depicted at 19.

Along the common path of paper web 16 and support band 18, as from an upper drying cylinder 10 or 12 to a lower drying cylinder as 11 or 13, respectively, an air guide box 20, for each, is provided and situated as to be on or at the side of the support band 18. Each of such air guide boxes is preferably rigid and has a length equal to or even slightly smaller than the width of the paper web 16. Further, each of such air guide boxes is situated as to extend transversely of the path of the paper web 16 and support band 18 of the dryer section.

As generally typically illustrated in FIG. 2, in the preferred embodiment of the invention the air guide box 20 is substantially closed on all sides and comprises a first wall 21 which is situated as to be spaced from but extend generally along the juxtaposed portion of the support band 18. The spacing between the first wall 21 and support belt means 18 defines a gap 23 which diverges as it progresses toward the gore or gore-like space 22; that is, the distance between wall 21 and support band 18 at the gore end is preferably greater than the distance between wall 21 and support band 18 as at the inlet or feed-side edge 24 of wall 21. As depicted, in the preferred embodiment, the inner-most end of wall 21 extends into the gore 22.

An air wipe-off strip 25 is preferably carried at the feed-side edge 24 of the first wall 21 and suitably secured thereto as to extend toward support band 18. The air wipe-off strip 25, which may be comprised of, for example, a felt strip or a brush-like member, extends to effectively close the space between what may be considered the upstream or inlet end of the box 20 and the juxtaposed portion of support band 18 thereby serving to, at such location, wipe-off the air boundary layer or film entrained by the moving support band 18. A blast air jet type scraper may also be directed against the support band 18.

The air guide box 20 preferably comprises a second wall 26 which is spaced from and forms a gap 27 between itself and the juxtaposed portion of the cylindrical surface of the drying cylinder 11. The second wall means 26 converges with the first wall means 21 as within the inlet gore 22. At the gore side of box 20, the air guide box 20 is provided with a projecting flange-like or nose shaped strip 28 serving as an extension of the first wall means 21 and extending beyond the juncture of convergent walls 21 and 26.

In the preferred embodiment the second wall 26 has a slit type opening 29 formed therethrough for the passage of air. The opening 29 extends in a longitudinal direction of box 20; in this case the longitudinal direction would be generally transverse to the plane of the drawing in FIG. 2. If desired, the opening or passage 29 may be bridged as by a plurality of webs, spaced from each other, to ensure, as in the case of very long air guide boxes 20, the stability of the sections of the second wall 26 located on both sides of the opening or passage 29. As can be seen in FIG. 2, in the preferred embodiment, the axis of flow of the opening 29 extends at an acute angle to the wall 26 as to have the flow therefrom directed generally away from gore 22.

The air guide box 20 is preferably provided with generally opposite end faces or walls 40 and 42 wherein end wall 42 may be totally closed while opposite end wall 40 may be provided with an inlet opening or passage 30 operatively connected to a source 44 of blast air.

A baffle means 31 is mounted within the interior of air guide box 20 and situated generally between the air inlet 30 and opening 29 as to be in the path of flow of the blast air from inlet 30 to opening 29. The baffle means 31 extends over the entire length of the box 20 and, together with the second wall means 26, defines a space 32 of nozzle type cross-section which generally funnels into the slit-like opening 29.

Further, in the preferred embodiment a channel means 33 is provided as to operatively and flowingly interconnect support band 18 side gap 23 with cylinder-side gap 27. In order not to suppress or unduly restrict the flow of blast air from the inlet 30 to the slit passage 29, channel means 33 is preferably formed or comprised of a plurality of passages or tubes 34 axially spaced from each other so that such spacing in effect spaces the plurality of tubes 34 longitudinally of the air box 20. In the preferred embodiment, the end of channel means 33 generally nearest the support band means 18 is situated generally in the middle third portion of the first wall means 21 while the end of channel means 33 which is generally nearest to the drying cylinder 11 when viewed or considered from the running direction of drying cylinder 11, as depicted by arrow 35, lies just ahead of or before the slit-like opening or passage means 29.

Further, in the preferred embodiment, the second wall means 26 is recessed, at an area or location generally between opening 29 and the gap-27-end of channel means 33, in the form of a step 36 so that in counterflow direction the gap 27 undergoes an abrupt cross-sectional expansion. Still further, the air guide box 20 may be equipped on the inner or gore end side, in a manner not shown, with air barrier strips of felt or brush strips which, directed against the support band means 18, extends along the first wall means 21 into the tip of the inlet gore 22. Similarly, the second wall means 26 may be provided with such air barrier strips directed against the surface of the associated drying cylinder 11.

On its way to the slit opening 29, the blast air flowing through the air box 20 passes through what may be referred to as a throttling gap or space 37 effectively defined between the interior of the first wall means 21 and the baffle 31. The effect of having the blast air thusly "throttled" results in the pressure of such air being at least more evenly or equally distributed over the length of the air guide box 20. In the nozzle-shaped space 32 the blast air undergoes an acceleration so that it enters gap 27 at a high speed counter to the running direction (arrow 35) of the drying cylinder 11 (or 13 as the case may be). In the course of its path of flow through the cylinder-side gap 27, the blast air detaches the air boundary or layer entrained by the drying cylinder and thus prevents its infiltration into the inlet gore 22. The air wipe-off means 25 at the inflow side edge 24 of the first wall means 21 deflects away a significant portion of the air boundary layer at the support band means 18 tending to otherwise flow toward and into the inlet gore 22. The previously described divergence in and of gap 23 creates a vacuum within such gap 23 during running of the support band means 18 and the paper web 16. This created vacuum, in turn, serves to hold the paper web 16 in full contact against the support belt means 18. Further, the supply of blast air which flows out of the opening or passage 29 and into and through gap 27 also has an effect on the opposite gap 23. That is, as such blast air is ejected through slit or opening 29 and flows past the cylinder-end of channel means 33, a suction effect is created at such cylinder-end of channel means 33 causing at least a substantial portion of the air as may be in gap 23 upstream of channel means 33 to flow through the channel means 33 and into gap 27 to be swept away by the blast air from passage means 29. Further, the direction of flow of blast air out of discharge passage means 29 causes the creation of a reduced pressure or partial vacuum in gap 27 generally in the area from passage or outlet means 29 and extending into the inlet gore 22. Consequently, such air as may exist in gap 23, generally downstream of the support-band-end of channel means 33, as well as the air as may exist in gore 22 is caused to flow through gap 27, as generally depicted by the arrows in FIG. 2, to be swept outwardly therefrom by the blast air.

As should now be completely apparent, the invention provides apparatus, more particularly air guide box means, which is effective for securely holding the paper web 16 against the support band means 18 until such effectively continuous paper web 16 and continuous support band means 18 until such have actually entered the related inlet gore and are in the process of passing about and in contact with the associated drying cylinder as, for example, cylinder 11. Furtheer, the air guide box means 20 of the invention has an especially small rate of blast air requirement, as compared to the prior art and, for all practical purposes is insensitive to dirt and effectively immune from becoming inoperative because of an accumulation therein of dirt or foreign particles.

Contrary to the teachings of said prior art reference DE3148578 A1, in the apparatus of the invention blast air is directed only to the cylinder-side gap 27; this is a distinct advantage inasmuch as the smooth surface of the drying cylinder offers little resistance to the flow of the blast air and, therefore, comparatively little blast air is required for wiping the air boundary layer off the drying cylinder surface. Together with the wiping effect of the air wipe-off strip 25 associated with the support band 18 and the ejection effect of the blast air stream on the air which has penetrated into the inlet gore on the support band 18 side, a vacuum is created therein (within gap 23), which securely holds the paper web 16 against the support band 18 in this especially critical region.

The full contact transportation of the paper web 16 by and along with the support band means 18 is further improved, by the apparatus of the invention, as a result of having the band-side gap 23 diverge in the running direction of the band 18. The wiping-off of the air boundary layer at the support band (as by means 25) creates a vacuum in gap 23 and such created vacuum increases in magnitude as the cross-section of gap 23 increases (in the band-running direction) thereby increasing at least the tendency for air flow through the paper web 16 and support band 18 into gap 23. This, of course, results in an improved contact of the paper web 16 with or on the support band means 18.

The apparatus of the invention further improves upon the teachings of said prior art reference WO81/01428 by having the channel means 33 which serves to convey air from the bandside gap 23 to the cylinder-side gap 27. This effect is basically attributable to the fact that in the invention blast air flowing through gap 27, at high speeds, exerts a suction effect on the channel means 33 resulting in an injection of air, from band-side gap 23, into channel means 33. As previously indicated, in the preferred embodiment, the discharge end of the channel means 33 is situated as to first traversed by the juxtaposed portion of the associated drying cylinder prior to the traversal of the discharge slit or opening 29.

Further, in the preferred form of the invention, the ejection effect of the blast air, through the channel means 33, is enhanced by the fact that the second wall means 26 is recessed, as at 36, between the opening 29 and the discharge or out-flow end of channel means 33. This, in turn, achieves stratification thereby at least minimizing, if not avoiding, flow resistances of the two air flows, namely, the blast air and the air issuing from the channel means 33 into gap 27.

In order to achieve at least generally uniform pressure distribution throughout the length of the air guide box 20, the back-pressure body or baffle means 31 is situated in the path of flow of the blast air and between the inlet, of said blast air, and the discharge or outlet 29. A further feature of such baffle means 31 is that is is situated in such a manner, and is of such comformation, as to cooperate with, for example wall means 21 to define a space of nozzle-shaped cross-section which changes-over or generally blends into and leads to the slit type opening or discharge means 29.

Also it is contemplated that even further advantages can be obtained by providing air barrier strips 50 and 52 (much like means 25) directed against the support band means 18 and extending in the running direction thereof into the gore tip such barrier strips 50 and 52 preferably extending to and including the longitudinally spaced ends (as at 40 and 42) of the air guide box 20. The side barriers 50 and 52, as generally depicted in FIG. 3, may be suitably respectively secured to end walls 40 and 42. In this manner the entry of air, from the lateral sides, into band-side gap 23 and into the inlet gore 22 is mostly suppressed. It should, of course, be obvious that the air guide box 20 is suitably secured with respect to the other cooperating elements in the dryer section.

Although only a preferred embodiment and selected modifications of the invention have been disclosed and described, it is apparent that other embodiments and modifications of the invention are possible within the scope of the appended claims.

What is claimed is:

1. An air guide box for a dryer section of a paper making machine where a paper web to be dried together with support band means meanders in a path over drying cylinders, wherein said air guide box extends longitudinally crosswise of said path of the dryer section between a first drying cylinder and a successive second drying cylinder, and wherein said air guide box extends along said support band means and into an inlet gore, said inlet gore being formed generally by and between said support band means and said second drying cylinder, said air guide box comprising first wall means extending generally along said support band means and into said inlet gore, said first wall means extending both transversely and longitudinally of said support band means, said first wall means being spaced from said support band means and defining therebetween first gap means, air wipe-off means for operatively acting against said support band means effective for wiping-off air generally carried by said support band means as said support band means moves past said first wall means and toward said inlet gore, second wall means generally juxtaposed to a portion of the cylindrical surface of said second drying cylinder, said second wall means being spaced from said cylindrical surface and defining therebetween second gap means, said second wall means converging with said first wall means generally in the area of said inlet gore, and opening means formed in said second wall means for operative connection to an associated blast air supply, said opening means being effective to deliver blast air into said second gap means directly against said cylindrical surface of only said second drying cylinder without first flowing through said support band means and as to have a direction of flow of said blast air in said second gap means counter to running direction of said second drying cylinder.

2. An air guide box for a dryer section of a paper making machine where a paper web to be dried together with support band means meanders in a path over drying cylinders, wherein said air guide box extends longitudinally crosswise of said path of the dryer section between two successive drying cylinders, and wherein said air guide box extends along said support band means and into an inlet gore, said inlet gore being formed generally by and between said support band means and a drying cylinder, said air guide box comprising first wall means extending generally along said support band means and into said inlet gore, said first wall means being spaced from said support band means and defining therebetween first gap means, air wipe-off means for operatively acting against said support band means effective for wiping-off air generally carried by said support band means as said support band means moves past said first wall means and toward said inlet gore, second wall means generally juxtaposed to a portion of the cylindrical surface of said drying cylinder, said second wall means being spaced from said cylindrical surface and defining therebetween second gap means, said second wall means converging with said first wall means generally in the area of said inlet gore, opening means formed in said second wall means for operative connection to an associated blast air supply, said opening means being effective to deliver blast air into said second gap means as to have a direction of flow counter to running direction of said drying cylinder, and channel means carried by said box, said channel means being effective to complete flow communication as between said first gap means and said second gap means.

3. An air guide box according to claim 2 wherein said channel means comprises inlet means communicating with said first gap means and outlet means communicating with said second gap means, and wherein said outlet means is so situated as to be effectively traversed by said drying cylinder during its rotation prior to the same portion of said drying cylinder traversing said opening means.

4. An air guide box according to claim 3 and further comprising recess means formed in said second wall means, said recess means being formed as to be located generally between said opening means and said outlet means of said channel means.

5. An air guide box for a dryer section of a paper making machine where a paper web to be dried together with support band means meanders in a path over drying cylinders, wherein said air guide box extends longitudinally crosswise of said path of the dryer section between two successive drying cylinders, and wherein said air guide box extends along said support band means and into an inlet gore, said inlet gore being formed generally by and between said support band means and a drying cylinder, said air guide box comprising first wall means extending generally along said support band means and into said inlet gore, said first wall means being spaced from said support band means and defining therebetween first gap means, air wipe-off means for operatively acting against said support band means effective for wiping-off air generally carried by said support band means as said support band means moves past said first wall means and toward said inlet gore, second wall means generally juxtaposed to a portion of the cylindrical surface of said drying cylinder, said second wall means being spaced from said cylindrical surface and defining therebetween second gap means, said second wall means converging with said first wall means generally in the area of said inlet gore, opening means formed in said second wall means for operative connection to an associated blast air supply, said opening means being effective to deliver blast air into said second gap means as to have a direction of flow counter to running direction of said drying cylinder, and baffle means carried internally of said guide box, said baffle means being situated as to be generally in the path of flow of said blast air and generally between said associated blast air supply and said opening means.

6. An air guide box according to claim 5 wherein said opening means comprises a slit type opening, wherein said baffle means combines with said second wall means to define a space of nozzle-shaped cross-section, and wherein said nozzle-shaped space in turn communicates with said slit type opening.

7. An air guide box for a dryer section of a paper making machine where a paper web to be dried together with support band means meanders in a path over drying cylinders, wherein said air guide box extends longitudinally crosswise of said path of the dryer section between two successive drying cylinders, and wherein said air guide box extends along said support band means and into an inlet gore, said inlet gore being formed generally by and between said support band means and a drying cylinder, said air guide box comprising first wall means extending generally along said support band means and into said inlet gore, said first wall means being spaced from said support band means and defining therebetween first gap means, air wipe-off means for operatively acting against said support band means effective for wiping-off air generally carried by said support band means as said support band means moves past said first wall means and toward said inlet gore, second wall means generally juxtaposed to a portion of the cylindrical surface of said drying cylinder, said second wall means being spaced from said cylindrical surface and defining therebetween second gap means, said second wall means converging with said first wall means generally in the area of said inlet gore, opening means formed in said second wall means for operative connection to an associated blast air supply, said opening means being effective to deliver blast air into said second gap means as to have a direction of flow counter to running direction of said drying cylinder, and side air barrier means operatively directed against said support band means and extending in the running direction of said support band means into said inlet gore.

* * * * *